US005813377A

United States Patent [19]

Matsunaga

[11] Patent Number: 5,813,377

[45] Date of Patent: Sep. 29, 1998

[54] ENGINE VALVE OPERATING SYSTEM

[75] Inventor: Nobuhiko Matsunaga, Iwata, Japan

[73] Assignee: Yamaha Hatsudoki Kabushiki Kaisha, Iwata, Japan

[21] Appl. No.: 744,056

[22] Filed: Nov. 5, 1996

[30] Foreign Application Priority Data

Nov. 7, 1995 [JP] Japan ..... 7-288660

[51] Int. Cl.[6] ..... F01L 13/00

[52] U.S. Cl. ..... 123/90.17; 123/90.6; 74/568 R; 251/251

[58] Field of Search ..... 123/90.15, 90.17, 123/90.18, 90.31, 90.6; 74/568 R; 251/251

[56] References Cited

U.S. PATENT DOCUMENTS 4,886,022 12/1989 Nakai ..... 123/90.17
5,404,770 4/1995 Kruger ..... 123/90.17
5,505,168 4/1996 Nagai et al. ..... 123/90.17

FOREIGN PATENT DOCUMENTS 3720947 1/1988 Germany ..... 123/90.17
3705128 9/1988 Germany ..... 123/90.17

*Primary Examiner*—Weilun Lo
*Attorney, Agent, or Firm*—Knobbe, Martens, Olson & Bear LLP

[57] ABSTRACT

A number of embodiments of valve-actuating mechanisms for reciprocating machines, such as internal combustion engines, are presented wherein the lift of the valve may be controlled. This is done by providing a pair of cams on the camshaft each of which cooperate with the same follower for commonly actuating the valve. One of the cams is radially shiftable relative to the axis of the camshaft so that it can either be brought into operative position wherein the lift is controlled by the second cam or an inoperative position where the lift of the valve is controlled by the first cam.

13 Claims, 8 Drawing Sheets

ENGINE VALVE OPERATING SYSTEM

BACKGROUND OF THE INVENTION

This invention relates to an engine valve operating system and more particularly to an improved mechanism for changing the degree of lift of a valve in a reciprocating machine such as an engine.

In many types of reciprocating machines and particularly internal combustion engines, there may be time when it is desirable to change the valve operating characteristics during the running of the engine. Conventional variable valve timing mechanisms (VVT) have been proposed for varying the timing of opening and closing of the valves in an engine. By providing such variable valve timing it is possible to obtain improved engine performance over a wider range of engine speed and load conditions.

In addition to changing the valve timing events, there is also a desire to provide a mechanism that will change the lift of the valve. By changing the lift of the valve, the induction and/or exhaust efficiency of the engine can be changed during running to offer further enhancements in engine performance. Although the changing of the timing of the opening and closing of the valves utilizing a VVT mechanism is relatively easy to accomplish, the changing of the lift of the valve is more difficult to accomplish.

Because of the difficulty in changing the lift of the valve during the actual running of the engine, very complicated mechanisms have employed. Generally, one type of these mechanisms include follower devices that are interposed between the actuating camshaft and the valve and which change the degree of lift by changing the mechanical advantage between the cam and the actuated valve. Obviously, these systems become quite complicated. Furthermore, they frequently add to the reciprocating mass of the engine and can thus, deteriorate to some extent the engine performance.

In some instances, the variable lift is provided by substituting for the conventional type of cam and follower arrangement, an actual driving system which drives the valve without necessitating the use of a camshaft. These mechanisms become even more complicated than the variable follower mechanisms.

It is, therefore, a principal object of this invention to provide a variable lift valve-actuating mechanism for a reciprocating machine that easily permits the lift to be changed without significantly adding to the complexity of the actuating mechanism.

It is a further object of this invention to provide an improved camshaft arrangement for providing variable lift for the valve of a reciprocating machine.

It is a still further object of this invention to provide an improved engine camshaft for achieving variable valve lift in a relatively simple and inexpensive manner.

SUMMARY OF THE INVENTION

This invention is adapted to be embodied in a valve-actuating mechanism for a reciprocating machine. The valve-actuating mechanism is comprised of a camshaft that is journaled for rotation by the machine and driven in timed relationship with it. A first cam is fixed upon the camshaft and is rotatable with the camshaft. A second cam is also provided which is fixed for rotation with the camshaft but which is moveable relative to the camshaft in a direction radial to the axis of the rotation of the camshaft. The first and second cams are juxtaposed to each other for actuation of the valve through the same element. Means are provided for adjusting for the radial position of the second cam so that either the first cam or the second cam are operative to actuate the valve.

DETAILED DESCRIPTION OF THE PREFERRED EMBODIMENTS OF THE INVENTION

Figure 1:
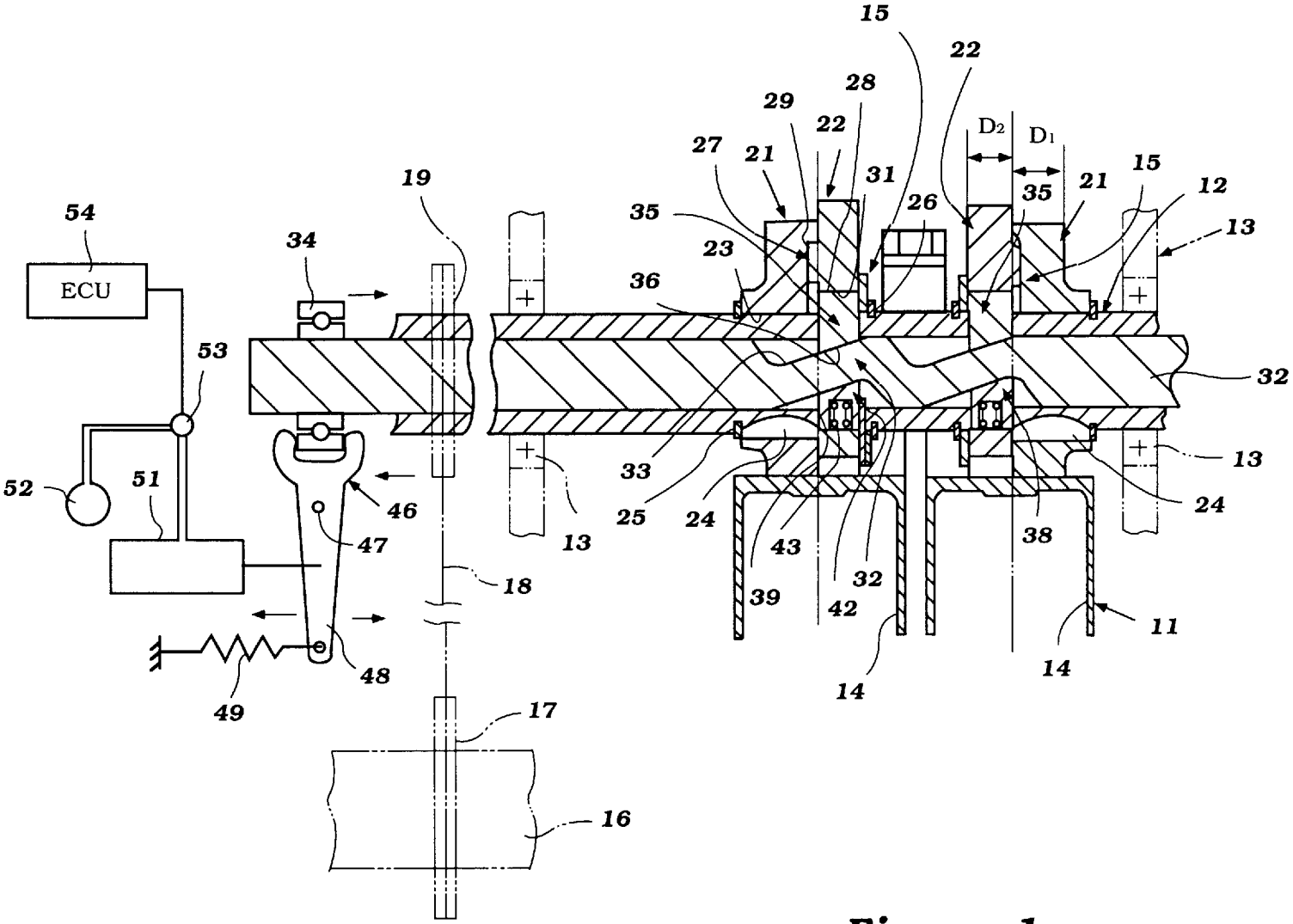
FIG. 1 is a partial cross-sectional view taken through a portion of the cylinder head of an internal combustion engine having a variable left mechanism constructed in accordance with a first embodiment of the invention, with portions of the actuating mechanism as well as the drive for the camshaft shown schematically.
Figure 2:
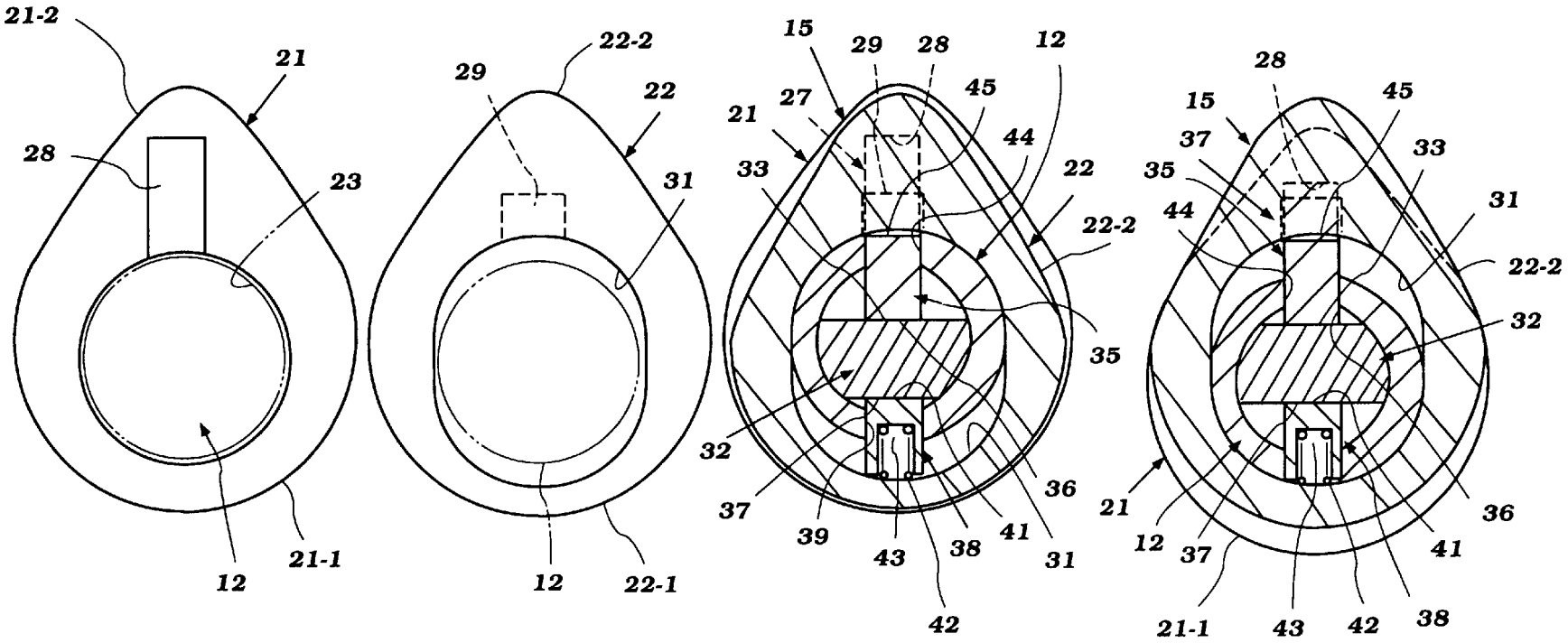
FIG. 2 is a series of cross-sectional views taken along a plane perpendicular to the axis of rotation of the camshaft and showing from left to right: the low speed cam, the high speed cam, the combined mechanism in the low speed, low load condition and the combined mechanism in the high speed, high load condition.

Referring first to the embodiment of FIGS. 1 and 2, a portion of the cylinder head of an internal combustion engine is depicted but is shown only partially. This cylinder head is formed with a cam chamber 11 in which a camshaft, indicated generally by the reference numeral 12 is journaled on longitudinally spaced bearings, indicated in phantom and identified by the reference numeral 13. The camshaft is associated with a pair of valve-actuating tappets 14 that are slidably supported in bores formed in the cylinder head and which extend into the cam chamber 11 for cooperation with cam assemblies, indicated generally by the reference numeral 15 for controlling the position of associated poppet-type valves (now shown).

The base cylinder head and valves and way in which the tappets 14 cooperate with the valves is not illustrated because those skilled in the art will readily understand this portion of the construction. Therefore, the disclosure is directed primarily to the construction of the camshaft 12, its association with the cams 15 and the way in which the cams 15 are reconfigured during engine running so as to vary the lift of the valves operated by the tappets 14.

The engine includes a crankshaft 16 that is journaled in a cylinder block to which the cylinder head is affixed. This crankshaft 16 drives a sprocket 17 which, in turn, drives a chain 18 for driving a further sprocket 19 that is affixed to the camshaft 12 for driving it at one half (½) crankshaft speed as is well-known in the art. If desired, a VVT mechanism may be included in the drive for the camshaft 12 so that not only the lift but also the timing of opening and closing of the valves can be adjusted.

Each cam mechanism 15 is comprised of a low-speed/low-load cam, indicated generally by the reference numeral 21, and a high-speed/high-load cam, indicated generally by the reference numeral 22. These respective cams 21 and 22 are shown in the two left-hand views of FIG. 2. Each cam 21 and 22 is formed with a respective heel portion 21-1 and 22-1 and a lift or lobe portion 21-2 or 22-2. The cams 21 and 22 are both connected for simultaneous rotation with the camshaft 12 in a manner which will be described shortly, However, the high-speed cam is also mounted in a manner which will be described, on the tubular camshaft 12 for movement in a radial direction so as to change the effective lift of the camshaft, as will be described shortly.

The cam lobe 21 may be keyed, by a key 24 to the tubular camshaft 12 so that it rotates simultaneously with it. A retainer ring 25 holds the low-speed cam 21 axially on the camshaft 12.

The second, high-speed/high-load cam 22 is held axially on the tubular shaft 22 by means of a retainer ring 26. This retainer ring 26 also assists in causing an interlocking driving relationship, indicated generally by the reference numeral 27 to be established between the two cams 21 and 22. Hence the cam 21 drives the cam 22.

The cam 21 has a groove 28 in its face which faces the cam 22. The cam 22, in turn, has a lug 29 that is trapped in the groove 28 and which thus establishes a rotary driving connection between the two cams 21 and 22. This connection, however, permits the cam 22 to move radially relative to the cam 21 while maintaining the angular relationship therebetween.

As may be best seen in FIG. 2, the cam 22 has an elliptical-shaped opening 21 that provides a clearance around the tubular camshaft 12 so as to permit the cam 22 to be moved from the position shown in the third from the left view of FIG. 2 (the low speed low load and low lift position) to the position shown in the right-hand view of FIG. 2 and in solid lines in FIG. 1. This latter position is the high lift position.

Contained within the hollow interior of the tubular camshaft 12 is a cam-actuating shaft, indicated generally by the reference numeral 32. This cam-actuating shaft 32 is formed with a plurality of camming surfaces 33 which are generally axially aligned with the cams 22.

At one end of the camshaft assembly the cam-actuating shaft 32 extends axially beyond the tubular camshaft 12 and beyond its sprocket 19. A bearing assembly 34 is connected to this end of the cam-actuating shaft 32 and permits the cam actuating shaft 32 to rotate while being moved axially within the tubular camshaft 22. An actuating mechanism, to be described, is provided for achieving this operation.

As may be seen, there is associated with each of the cam surfaces 33 of the cam-actuating shaft 32 a follower plunger, indicated generally by the reference numeral 35. Each follower 35 has an inclined surface 36 that is engaged with the cam surface 33.

The side of the cam-actuating shaft 32 opposite to its camming surface 33 is formed with a further inclined surface 37. This inclined surface 37 is engaged by a spring-biased plunger assembly, indicated generally by the reference numeral 38. This plunger assembly is mounted in a bore 39 formed in the tubular camshaft 12 so that the plunger 38 will rotate along with the camshaft 12 as well as the cam-actuating shaft 32.

The plunger 38 has a surface 41 that is engaged with the cam-actuating shaft 37 and is biased into engagement with that surface by a coil compression spring 42 contained within a hollow opening 43 in the plunger 38. The spring 43 is engaged with the elliptical opening 31 of the second or high-speed cam 22.

In a similar manner, the plunger 35 is slidably supported within a bore 44 of the tubular camshaft 12 diametrically opposed to the bore 39. This plunger 35 has a surface 45 that engages the cam opening 31.

Thus, when the cam-actuating shaft 32 is moved to the left as seen in FIG. 1 from the position shown in the third view of FIG. 2 to the final view of this figure, the plunger 35 will be urged upwardly and will engage the cam 22 and move it so that its lobe 22-2 extends radially beyond the lobe 21-2 of the first cam 21. Thus, the cam 22 will effect the total amount of lift of the tappet 14 and its associated valve and will increase the actual lift even though the lift of the cam 22 itself is not greater than that of the cam 21. By moving the cam 22 radially outwardly in the direction of its lobe surface 22-2, the effective lift is increased, as should be readily apparent. Thus, it is possible to change the lift of the tappet 14 and the associated valve when the engine is running and without a complicated mechanism being interposed between the cams 21 and 22 and the tappet 14 or other valve-actuating element.

It should also be noted that the axial length D2 of the second cam 22 is not greater than and preferably is less than the axial length D1 of the first cam 21. As may be seen, only a small portion of the cam lobe 22-2 extends beyond the cam lobe 21-2 even in the full lift position and thus the load on this lobe is less than that on the primary or first lobe 21.

The mechanism for effecting the axial movement of the cam-actuating shaft 32 will now be described by reference to FIG. 1. This includes a yoke-like member, indicated generally by the reference numeral 46 that captures the bearing 34. The yoke member 46 is pivotally supported on a pivot pin 47 and has an actuating arm 48 which is biased by a spring 49 in the left so as to move the cam-actuating shaft 32 to the right or to the low-speed/low-load condition. Thus, if there is failure in the actuating mechanism, the mechanism will fail safe to the low-speed/low-load and low lift condition.

In order to effect movement in the high-speed/high-load high lift condition, an oil pressure actuator system comprised of the pressure cylinder 51 is provided which is actuated from an oil pressure source 52 via a solenoid control valve 53. The valve 53 is operated from an ECU 54 with any control strategy which senses either engine speed and/or engine load. When high-speed/high-load conditions prevail, the valve 53 is open so that the actuator 51 will pivot the actuating yoke 46 in the counterclockwise direction to move the cam-actuating shaft 32 to the left and cause the second cam 22 to be moved radially outwardly to the position shown in FIG. 1 and the right-hand side of FIG. 2 to achieve maximum lift of the associated poppet valve.

Figure 3:
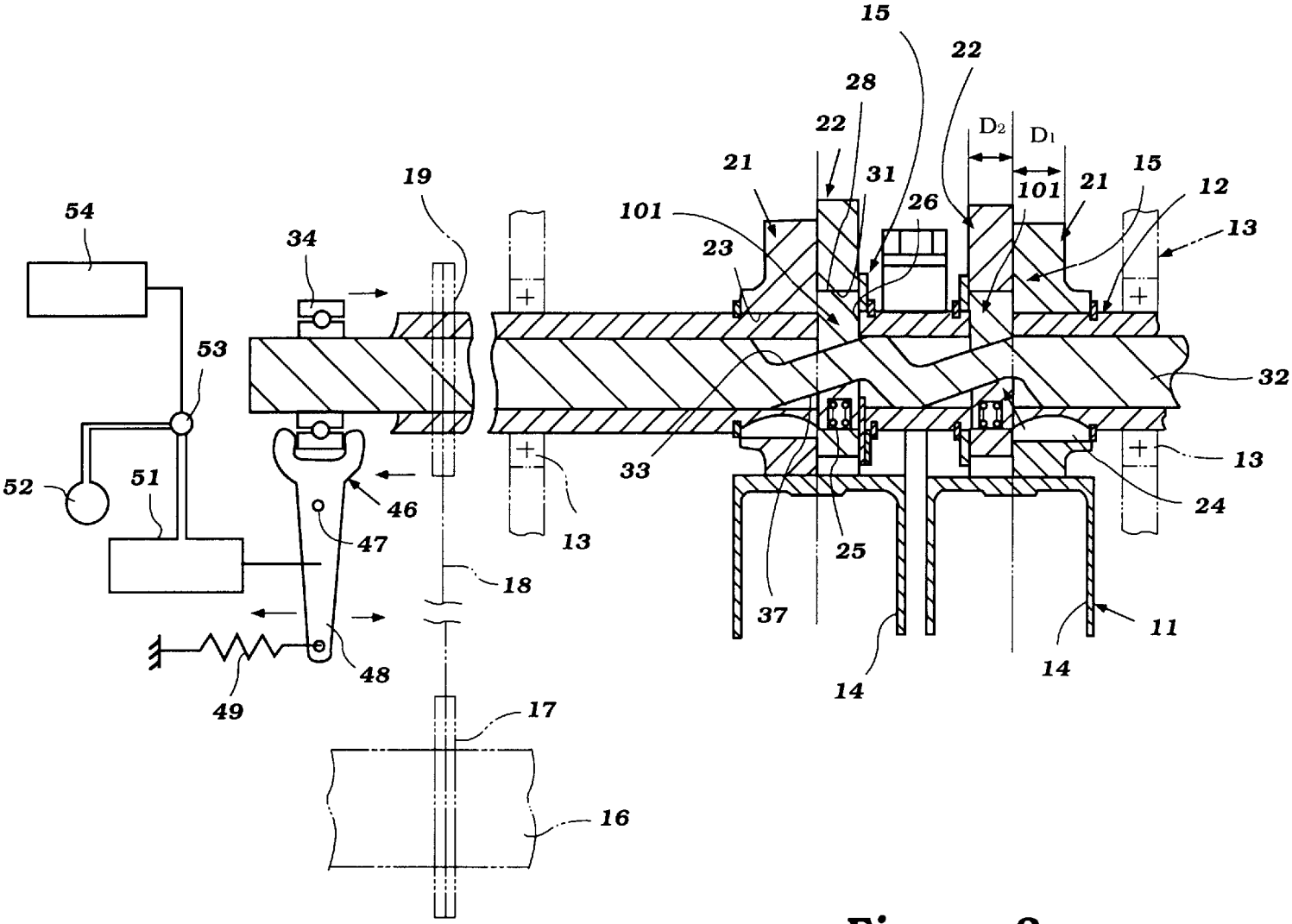
FIG. 3 is a partial cross-sectional and partially schematic view, in part similar to FIG. 1, and shows a second embodiment of the invention.
Figure 4:
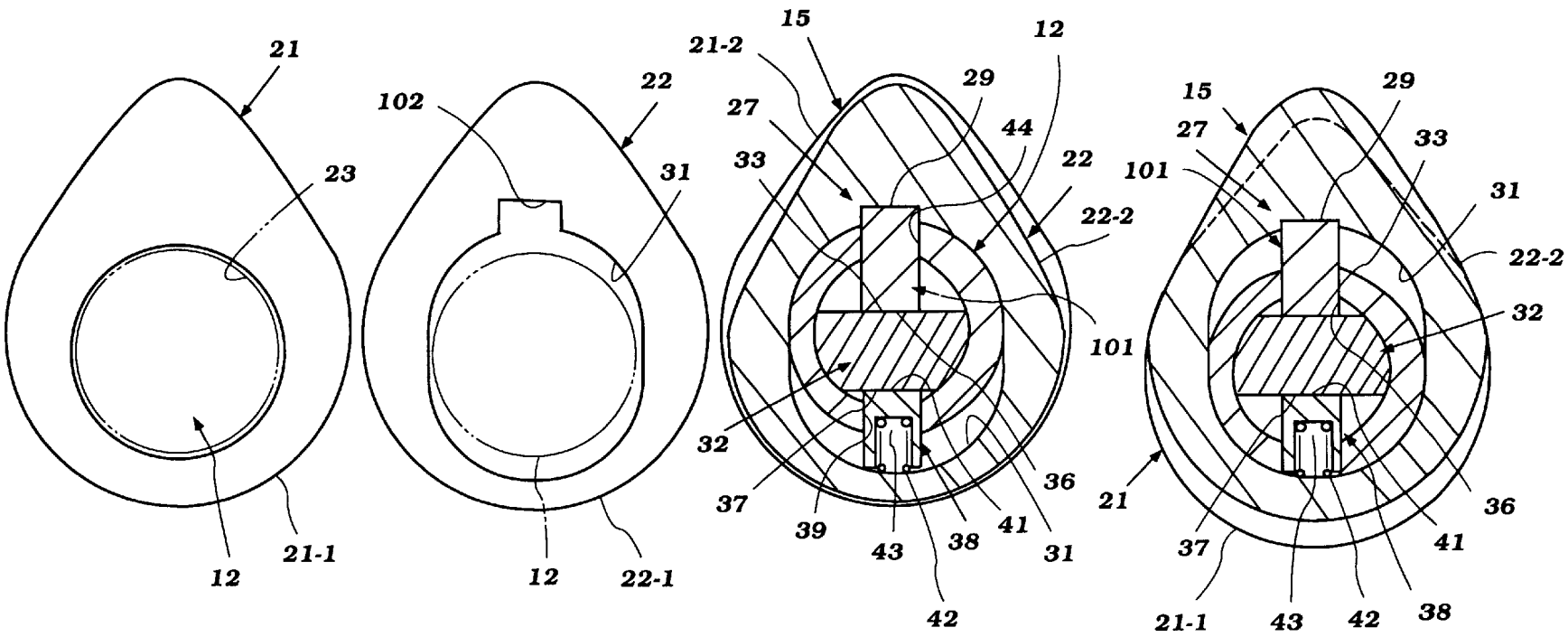
FIG. 4 is a multi-part view, in part similar to FIG. 2, but showing the cam mechanism of the embodiment of FIG. 3 in four views that correspond to the views of FIG. 2.

FIGS. 3 and 4 show another embodiment of the invention which is substantially the same as the embodiment of FIGS. 1 and 2. Therefore, where components of this embodiment are the same or substantially the same as the previously described embodiment, they have been identified by the same reference numerals and will be described again only insofar as is necessary to understand the difference between this embodiment and the previously-described embodiment.

In this embodiment, the interlocking mechanism 35 between the cams 21 and 22 is deleted. Thus, there is no direct driving connection between the cams 21 and 22. In this embodiment, however, the actuating plunger 35 of the previous embodiment is extended as indicated by the new plunger 101 so as to be constantly engaged in a key 102 of the second cam 22. Hence, even in the low-speed condition as shown in the third view of FIG. 4, the plunger 101 is engaged in the groove 102 and thus establishes a driving connection between the tubular camshaft 12 and the cam 22 because of the key-like action of the plunger 101 and groove 102. Hence, the construction can be simplified by this structure and still maintain constant rotation of both cams 21 and 22 regardless of which one is actually operating the tappet 14 and associated valve.

Figure 5:
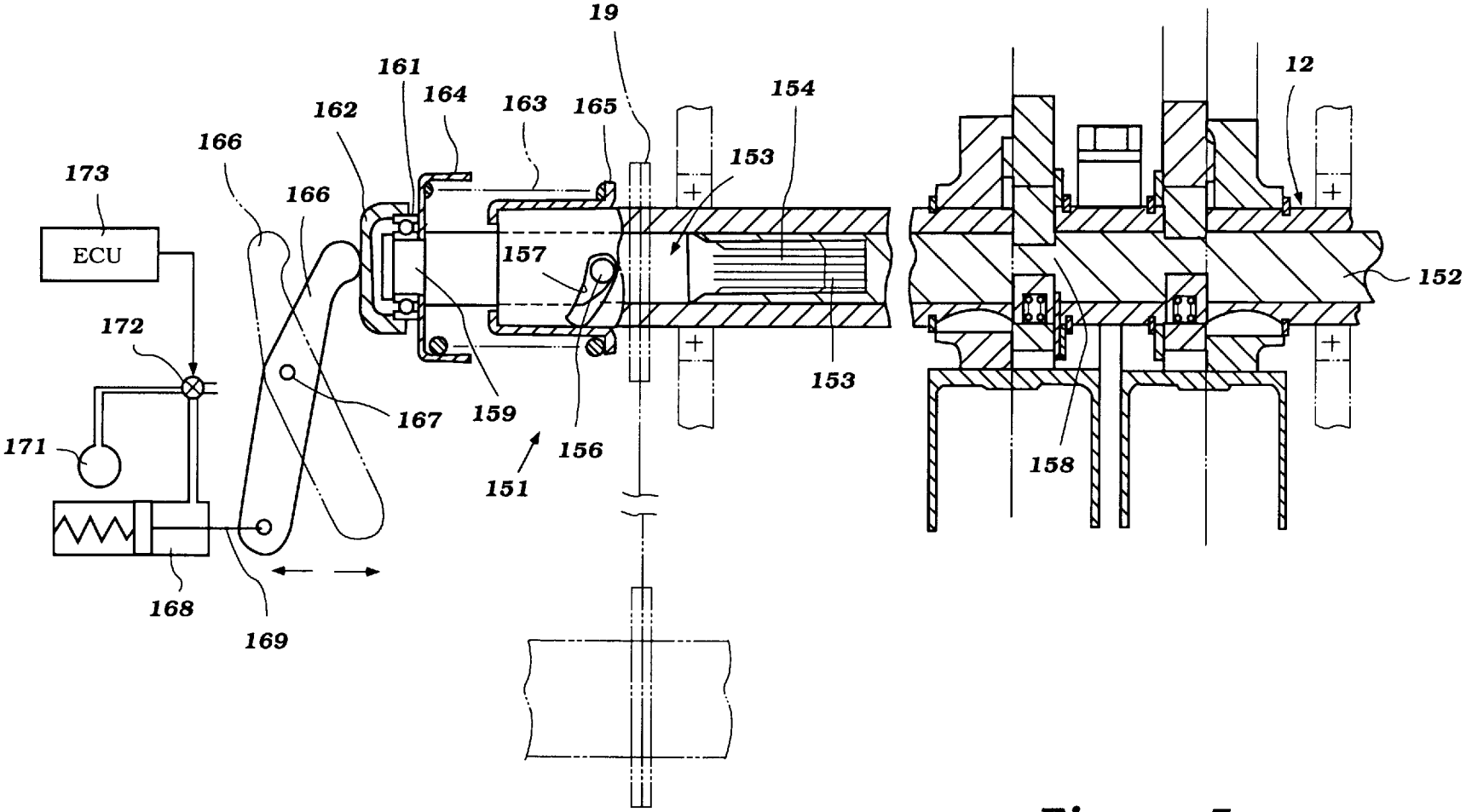
FIG. 5 is a partial cross-sectional and schematic view, in part similar to FIGS. 1 and 3, and shows a third embodiment of the invention.
Figure 6:
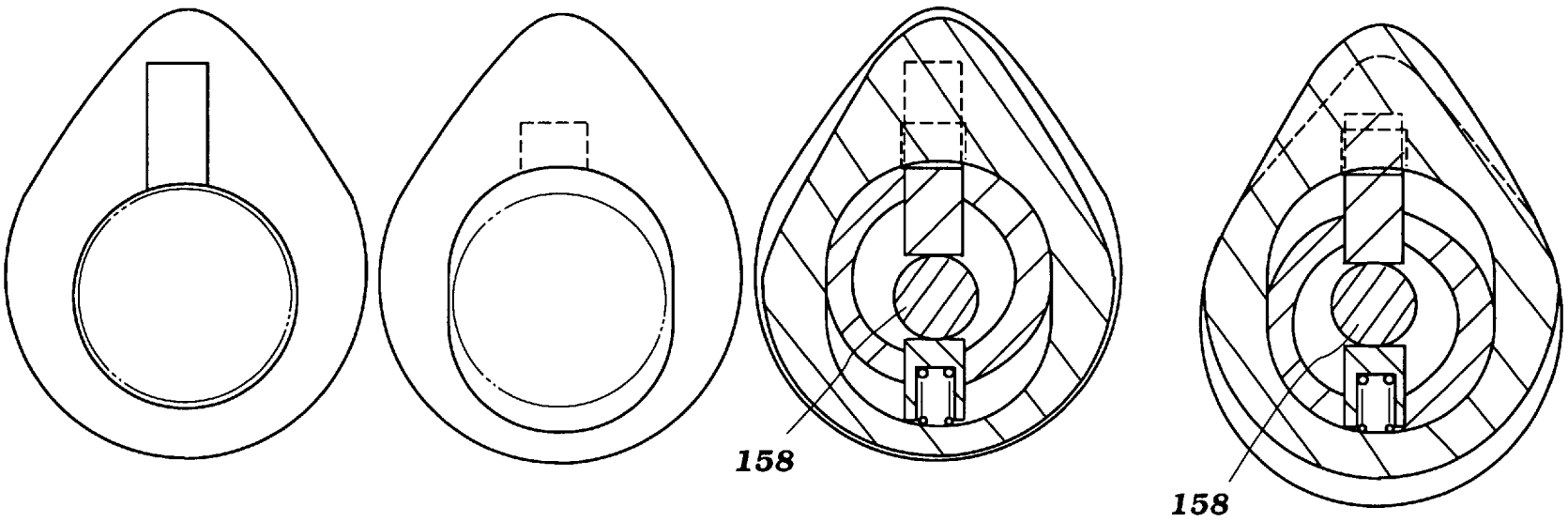
FIG. 6 is a view, in part similar to FIGS. 2 and 4, and shows the cam mechanism of his embodiment in the same four views.
Figure 7:
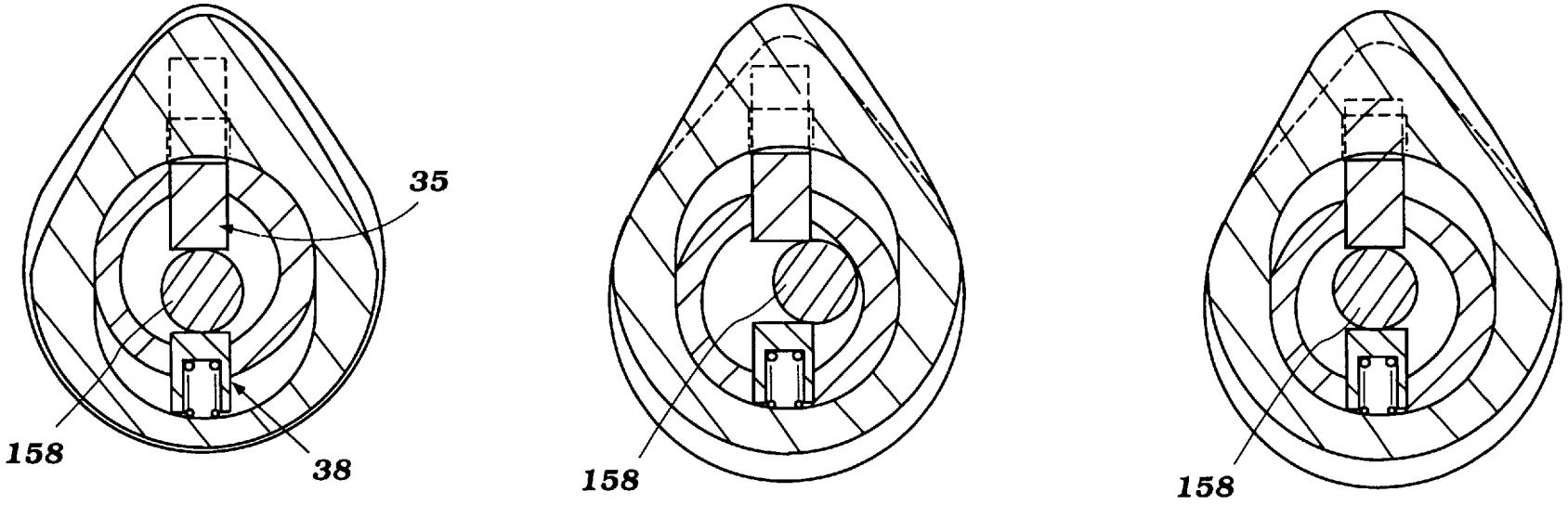
FIG. 7 is a view, in part similar to the right-hand two views of the FIG. 6 and further shows the transition from the low speed, low load operation to the high speed, high load operation.

FIGS. 5–7 show another embodiment of the invention. This embodiment is basically the same as the embodiment of FIGS. 1 and 2. For that reason, components of this embodiment which are the same as that embodiment have been identified by the same reference numerals and will be described again only insofar as is necessary to understand the construction and operation of this embodiment.

In this embodiment, the cam-actuating shaft does not move axially in order to change or actuate the second or high-speed cam 22. Rather, its phase angle is changed relative to that of the tubular camshaft 12. Thus, only the actuating mechanism, indicated generally by the reference numeral 151 and the cam-actuating shaft, indicated by the reference numeral 142 differs from the previously-described embodiment.

The cam-actuating shaft 152 is journaled within the tubular camshaft 142 and is rotatable relative to it to a limited extent. To achieve this operation, the one end of the cam-actuating shaft 152 terminates within the tubular camshaft 12 and is formed with a splined opening 153. A splined projection 154 of an actuating shaft 155 is received within this splined opening 153.

The actuator 152 has a pin 156 affixed to it which is received within a helical slot 157 formed in the one end of the tubular camshaft 12 beyond its forward-most journal and forwardly of the sprocket 19. Thus, when the actuator 155 is moved axially, it will also rotate relative to the tubular camshaft 12 so as to change the angular phase between the cam-actuating shaft 152 and the camshaft 12. The mechanism for achieving this axial movement and phase rotation will be described later.

In this embodiment, the cam-actuating shaft 152 is formed within cylindrical sections 158 which have generally the shape of the crank journals of a crankshaft. Hence, these cylindrical sections 158 are received between the cam-actuating plunger 35 and the backup plunger 38. Hence, when the phase of the cam-actuating shaft 152 is changed relative to the tubular shaft 12 as shown in FIG. 7, the cam-actuating shaft cylindrical portion 158 will move so as to extend the plunger 35 and cause the cam 22 to move radially outwardly so as to change the lift of the valve. This movement can continue for 180° of relative rotation to the position shown at the right-hand side of FIG. 7 so as to achieve maximum lift which is also shown at the right-hand side of FIG. 6.

The mechanism for causing this rotation will now be described by reference to FIG. 5. It will be seen that the actuator 155 extends axially beyond the tubular camshaft 152 and has a portion 159 that is journaled in a bearing 161 and which is engaged by an actuating cap 162. A coil compression spring 162 is loaded between a pair of retainers 164 and 165 that are axially fixed to the actuator 155 and tubular camshaft 12, respectively. Hence, in the fail-safe mode the actuator 155 will move to the left under the action of the spring 163. In this position, the phase angle between the shafts 152 and 12 is such that the cylindrical section 158 will be at the bottom or diametrically opposite the plunger 35 as shown in the left-hand side of FIG. 7. This is, like the other embodiments, the fail-safe position for the device.

In this embodiment, an actuating lever 166 is pivotally supported on a pin 167 and has an end portion that is engaged with the cup-shaped actuator 162. A hydraulic cylinder 168 is connected by a piston rod 169 to the opposite end of the actuator link 166. A source of hydraulic fluid 171 can communicate with the cylinder 168 through a solenoid control valve 172 so as to move to the position shown in solid lines in FIG. 5 so as to rotate the phase of the shaft 152 relative to the shaft 12 to the position shown in the right-hand side of FIG. 7 and in FIGS. 6 and 5. An ECU 173 actuates the valve 172 in response to engine running conditions such as load and/or speed as previously described.

Figure 8:
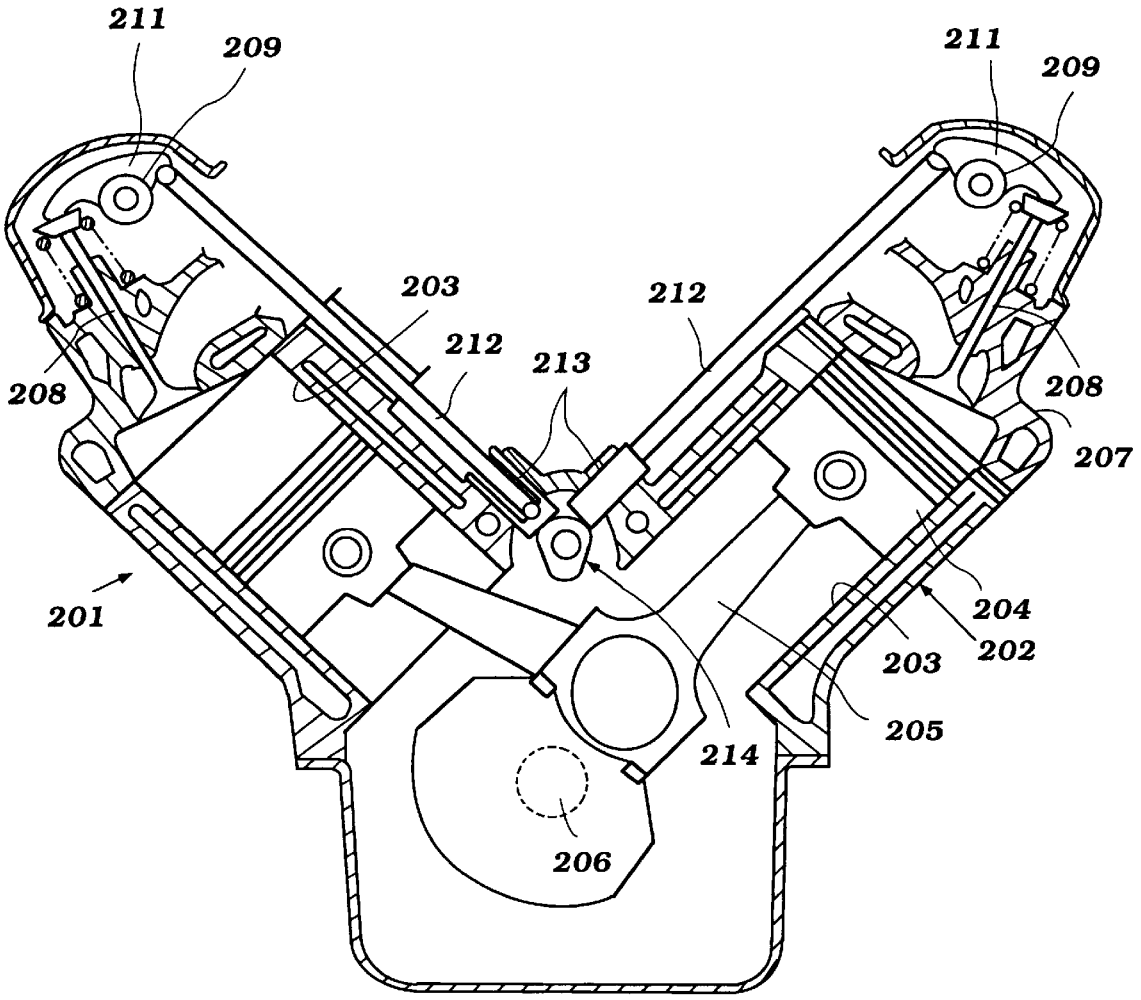
FIG. 8 is a longitudinal cross-sectional view taken through a V-type engine showing how the invention can be practiced in conjunction with a pushrod type of engine.

The invention as thus far described has been associated with an engine having an overhead camshaft in which the valves are directly actuated. It should be readily apparent, however, that this mechanism, since it is actuated in the cam mechanism itself, can be utilized with any type of valve-actuating mechanism. FIG. 8 shows such an embodiment as applied to a push rod-type actuated V-type engine, indicated generally by the reference numeral 201. The engine 201 has a cylinder block 202 in which cylinder bores 203 are formed. Pistons 204 reciprocate in these cylinder bores 203 and are connected by means of connecting rods 205 to a crankshaft 206.

Cylinder heads 207 are affixed to the cylinder banks of the cylinder block 202 and close the upper ends of the cylinder bores 203. Poppet-type valves 208 are mounted in the cylinder heads 207 and control the admission of a charge or discharge of the burnt charge to the combustion chambers.

Rocker arm shafts 209 are fixed in the cylinder heads 207 and journal rocker arms 211. One end of each rocker arm 211 is associated with the stem of a respective valve 208. The other end is engaged with a push rod 212. The push rods 212 extend downwardly and are engaged with tappets 213. The tappets 213 are, in turn, operated by a camshaft 214. The camshaft 214 is journaled at the base of the valley between the cylinder blocks and is driven by the crankshaft 206 through any suitable timing mechanism so as to rotate at onehalf crankshaft speed.

Any of the camshaft variable lift mechanism shown in either the embodiments of FIGS. 1 and 2, 3 and 4, or 5 through 7 may be employed with the camshaft 214 for changing the lift of the valves 208 as should be readily apparent to those skilled in the art.

Thus, from the foregoing description it should be readily apparent that the described embodiment of the invention provide a very effective and simple mechanism for changing the lift of the valves in a reciprocating machine such as an engine while the engine is running. Of course, the described embodiments are only preferred embodiments of the invention and various changes and modifications may be made without departing from the spirit and scope of the invention, as defined by the appended claims.

What is claimed is:

1. A valve-actuating mechanism for a reciprocating machine comprised of a camshaft journaled for rotation by said machine and driven in timed relationship with said machine, a first cam fixed upon said camshaft and rotatable with said camshaft, a second cam fixed for rotation with said camshaft and moveable relative to said first cam in a direction radial to the axis of rotation of said camshaft, said first cam and said second cam being juxtaposed to each other for actuating said valve trough the same element, said first and said second cams being interlocked for simultaneous rotation with said camshaft through a direct keyed relationship between sad first cam and said second cam that maintains a constant driving relationship between said first cam and said second cam regardless of the radial position of said second cam, said direct keyed relationship being provided by a radial groove formed in the face of said first cam adjacent said second cam and a key on said second cam extending into said radial groove, and mean for controlling the radial position of said second cam so that either said first cam or said second cam is operative to actuate said valve.

2. A valve-actuating mechanism as set forth in claim 1, wherein the second cam has a lobe, and the lobe is shifted radially for effecting operation of the valve by the second cam lobe.

3. A valve-actuating mechanism as set forth in claim 2, wherein the base circle of the cams is such that the base circle of the first cam is greater than the base circle of the second cam.

4. A valve-actuating mechanism as set forth in claim 3, wherein the closed position of the valve is controlled under all conditions by the first cam.

5. A valve-actuating mechanism for a reciprocating machine comprised of a tubular camshaft journaled for rotation by said machine and driven in timed relationship with said machine, a first cam comprised of a lobe and an integral base circle portion fixed upon said camshaft and rotatable with said camshaft, a second cam comprised of a lobe and an integral base circle portion fixed for rotation with said camshaft and moveable relative to said first said cam in a direction radial to the axis of rotation of said camshaft, said first cam and said second cam being juxtaposed to each other for actuating said valve through the same element the base circle of said cams being such that the base circle of said first cam is greater than the base circle of said second cam, and a cam actuating shaft positioned within the tubular interior of said tubular camshaft for controlling the radial position of said second cam so that the lobes of either said first cam or said second cam is operative to actuate said valve.

6. A valve-actuating mechanism as set forth in claim 5, wherein the closed position of the valve is controlled under all conditions by the first cam.

7. A valve-actuating mechanism as set forth in claim 5, wherein the first and second cam are interlocked for simultaneous rotation with the camshaft.

8. A valve-actuating mechanism as set forth in claim 7, wherein the cam actuating shaft is axially moveable relative to the camshaft.

9. A valve-actuating mechanism as set forth in claim 7, wherein there is a direct keyed relationship between the first cam and the second cam that maintains a constant driving relationship between said first cam and said second cam regardless of the radial position of said second cam.

10. A valve-actuating mechanism as set forth in claim 9, wherein the first cam is formed with a radial groove in the face adjacent the second cam and said second cam has a key extending into said groove to form the driving connection between said cams.

11. A valve-actuating mechanism as set forth in claim 7, wherein the first cam is keyed to the tubular camshaft and the second cam is coupled for rotation with said tubular camshaft by the means for radially moving the second cam.

12. A valve-actuating mechanism as set forth in claim 11, wherein the means for radially moving the second cam comprises a plunger reciprocal in a bore in the tubular camshaft and which plunger extends into an opening in said second cam for effecting a driving connection with said second cam.

13. A valve-actuating mechanism as set forth in claim 7, wherein the cam-actuating shaft is rotatable relative to the camshaft.

* * * * *

UNITED STATES PATENT AND TRADEMARK OFFICE

CERTIFICATE OF CORRECTION

PATENT NO. : 5,813,377
DATED : September 29, 1998
INVENTOR(S) : Nobuhiko Matsunaga It is certified that error appears in the above-identified patent and that said Letters Patent is hereby corrected as shown below:

Column 7, claim 1,
Line 5, "said valve trough" should be -- said valve through --.
Line 14, "and mean for" should be -- and means for --.

Signed and Sealed this

Twenty-fifth Day of December, 2001

*Attest:*

*Attesting Officer*

JAMES E. ROGAN
*Director of the United States Patent and Trademark Office*